US012312191B2

(12) United States Patent
Fukada

(10) Patent No.: US 12,312,191 B2
(45) Date of Patent: May 27, 2025

(54) FEEDING DEVICE AND IMAGE FORMING APPARATUS

(71) Applicant: CANON KABUSHIKI KAISHA, Tokyo (JP)

(72) Inventor: Ichiro Fukada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 18/061,071

(22) Filed: Dec. 2, 2022

(65) Prior Publication Data

US 2023/0183030 A1 Jun. 15, 2023

(30) Foreign Application Priority Data

Dec. 13, 2021 (JP) ..... 2021-201639

(51) Int. Cl.
*B65H 1/04* (2006.01)

(52) U.S. Cl.
CPC ..... *B65H 1/04* (2013.01); *B65H 2405/1122* (2013.01); *B65H 2511/11* (2013.01); *B65H 2511/20* (2013.01); *B65H 2553/61* (2013.01); *B65H 2553/82* (2013.01)

(58) Field of Classification Search
CPC ..... B65H 1/04; B65H 2405/1122; B65H 2511/11; B65H 2511/20
See application file for complete search history.

(56) References Cited

U.S. PATENT DOCUMENTS

| | | | | |
|---|---|---|---|---|
| 9,302,860 | B2 * | 4/2016 | Hirose | B65H 1/04 |
| 9,346,635 | B2 * | 5/2016 | Hirata | B65H 1/04 |
| 9,815,642 | B2 * | 11/2017 | Matsui | B65H 9/04 |
| 9,896,284 | B2 * | 2/2018 | Yang | G03G 15/6529 |
| 10,093,496 | B2 * | 10/2018 | Hyodo | B65H 1/04 |
| 2015/0054217 | A1 * | 2/2015 | Hirose | B65H 1/04 271/265.01 |
| 2016/0289018 | A1 | 10/2016 | Hyodo | |
| 2017/0275114 | A1 * | 9/2017 | Matsui | B65H 1/266 |
| 2021/0309468 | A1 | 10/2021 | Fukada | |

FOREIGN PATENT DOCUMENTS

| | | | |
|---|---|---|---|
| JP | 2000-219326 | A | 8/2000 |
| JP | 2003-089431 | A | 3/2003 |
| JP | 2007-320767 | A | 12/2007 |
| JP | 2015-040112 | A | 3/2015 |
| JP | 2016-193781 | A | 11/2016 |

* cited by examiner

*Primary Examiner* — Patrick Cicchino
(74) *Attorney, Agent, or Firm* — Venable LLP

(57) ABSTRACT

A feeding device includes an accommodating unit, a feeding member, a regulating member, a member-to-be-detected, a detecting device, and a connecting member. The regulating member contacts the member-to-be-detected in a first region with respect to a feeding direction and is spaced from the member-to-be-detected through the connecting member in a second region different from the first region with respect to the feeding direction.

10 Claims, 8 Drawing Sheets

FEEDING DEVICE AND IMAGE FORMING APPARATUS

FIELD OF THE INVENTION AND RELATED ART

The present invention relates to a feeding device and an image forming apparatus, and relates to, for example, the image forming apparatus such as a copying machine or a printer, and a sheet feeding device thereof.

In a conventional image forming apparatus such as the printer or the copying machine, a constitution including a stacking tray for accommodating large and small various-size sheets and a feeding unit for automatically feeding the sheets toward an image forming portion for forming images on the sheets is employed in general. Further, a part of image forming apparatuses includes a size detecting device which automatically detects the size of the sheet accommodated in the stacking tray force purpose of improving usability of a user.

The stacking tray used in the image forming apparatus is provided with an accommodating unit for accommodating the sheets, and the accommodating unit is capable of accommodating sheets with a plurality of sizes to a predetermined height. The accommodating unit is provided with a trailing end regulating member and a width regulating member so that a sheet bundle is set in a proper position of the accommodating unit. The trailing end regulating member regulates a position of a trailing end of the accommodated sheet with respect to a sheet feeding direction (hereinafter, referred to as paper trailing end). The width regulating member regulates a position of the sheet with respect to a direction (hereinafter, referred to as paper widthwise direction) perpendicular to the sheet feeding direction. Further, these regulating members are provided movably for regulating the sheets different in size.

The size detecting device detects the sheet size by detecting a member-to-be-detected, provided on a stacking tray side, with use of a size detecting portion provided on an apparatus main assembly side of the image forming apparatus in general. The member-to-be-detected is interrelated with a movement position of at least one of the trailing end regulating member and the width regulating member, and depending on the position, a logic level (high level or a low level) of a signal outputted from the size detecting portion changes. In a constitution of such a size detecting device, when the trailing end regulating member and the width regulating member are interrelated with each other for all of paper sizes, there was a problem such that a movement region of the member-to-be-detected becomes large and thus the size detection and downsizing of the image forming apparatus are not compatibly realized. As a solution means of this problem, a constitution in which the member-to-be-detected is selectively interrelated with only a part of a movement region of the regulating member has been proposed.

As a specific realizing means, a constitution in which the member-to-be-detected and the regulating member are connected with each other through a spring member and a link member and in which an interrelation region and a non-interrelation region are discriminated with each other has been proposed (for example, Japanese Laid-Open Patent Application (JP-A) 2016-193781). Further, a constitution in which a link member is provided between the member-to-be-detected and the regulating member and in which engagement between the regulating member and the link member and release of the engagement is switched depending on a position of the regulating member has been proposed (for example, JP-A 2007-320767).

However, in the conventional constitutions, the following problem arises. In the constitution in which the member-to-be-detected and the regulating member are connected with each other through the spring member and the link member and in which the interrelation region and the non-interrelation region are discriminated with each other, an external force acts on the member-to-be-detected in a region where the user intends to detect the sheet size. As a result, a relative position between the size detecting portion and the member-to-be-detected is deviated from a predetermined relationship, and in order to prevent erroneous detection, restriction design such as strength or accuracy of component parts arises. Further, in the constitution in which the link member is provided between the member-to-be-detected and the regulating member and in which the engagement between the regulating member and the link member and the release of the engagement is switched depending on the position of the regulating member, ensuring of an operation region (working region) of a swingable link member leads to narrowness of a region where the member-to-be-detected and the regulating member are capable of being in which each other. As a result, a degree of freedom of a detectable sheet size is small. In such conventional constitutions, compatibility between three of broad paper size detection, high stability in size detection, and downsizing of a size detecting mechanism cannot be realized, so that a means for solving this problem has been required.

SUMMARY OF THE INVENTION

The present invention has been accomplished in the above-described circumstances. A principal object of the present invention is to realize downsizing of a device (apparatus) for detecting a recording material size while accurately detecting recording materials with various sizes.

According to an aspect of the present invention, there is provided a feeding device for feeding a sheet, comprising: an accommodating unit configured to accommodate a recording material; a feeding member configured to feed the recording material accommodated in the accommodating unit; a regulating member movable in a feeding direction of the recording material by feeding member and configured to regulate a position of an end portion of the recording material on an upstream side of the feeding direction; a member-to-be-detected movable in the feeding direction in interrelation with the regulating member; a detecting device configured to detect a size of the recording material accommodated in the accommodating unit and of which out signal changes depending on the member-to-be-detected; and a connecting member connected to the regulating member at one end and to the member-to-be-detected at the other end and which urges the member-to-be-detected and the regulating member in a mutually attracting direction, wherein the regulating member contacts the member-to-be-detected in a first region with respect to the feeding direction and is spaced from the member-to-be-detected through the connecting member in a second region different from the first region with respect to the feeding direction.

According to another aspect of the present invention, there is provided an image forming apparatus comprising the above-described feeding device; and an image forming portion for forming an image on the recording material fed from the feeding device.

Further features of the present invention will become apparent from the following description of exemplary embodiments with reference to the attached drawings.

Figure 5:
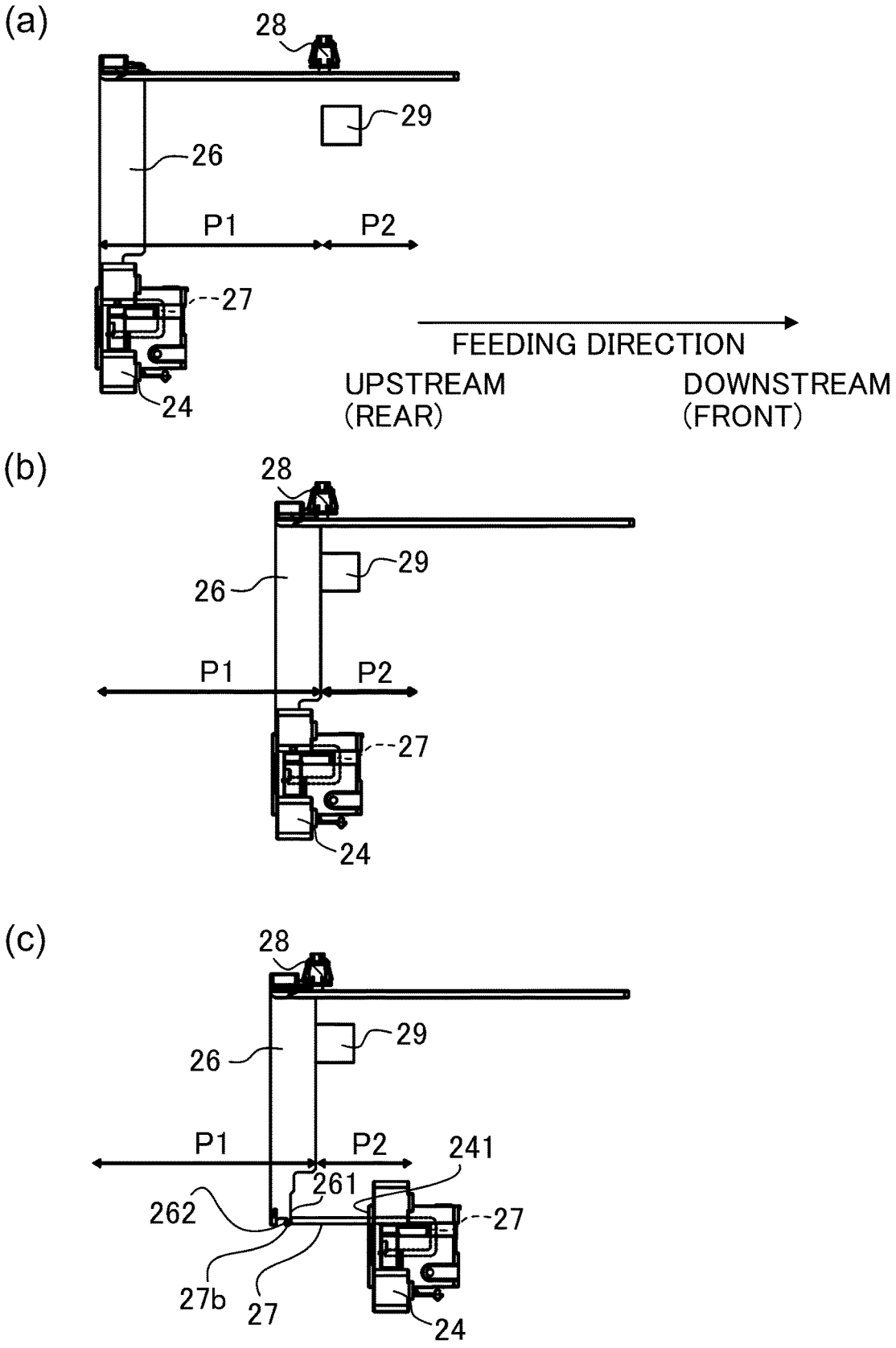

Parts (a), (b) and (c) of FIG. 5 are schematic views showing interrelation spacing operations between a trailing end regulating plate and a detecting plate in the embodiment 1.

Figure 6:
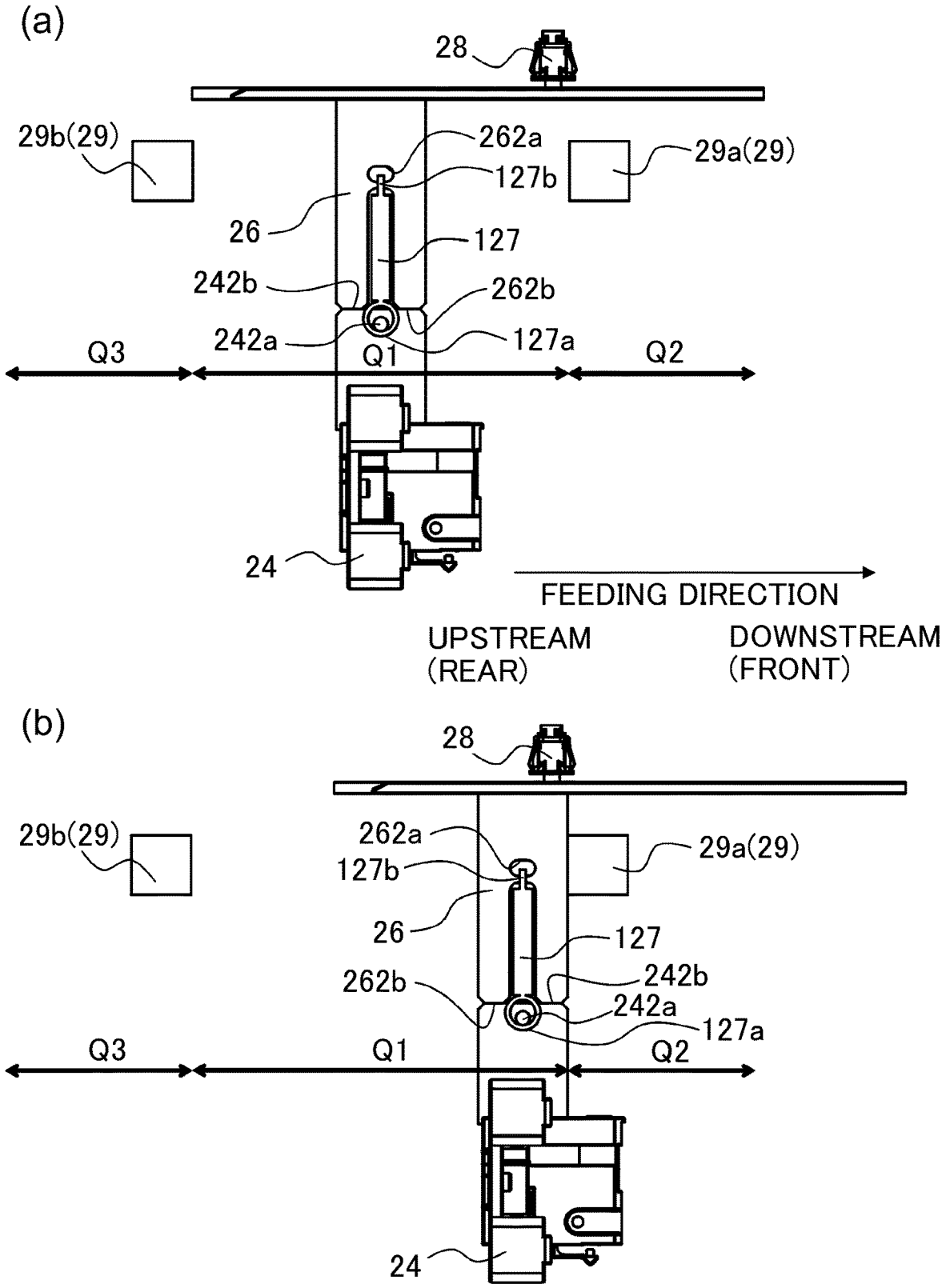

Parts (a) and (b) of FIG. 6 are schematic views showing interrelation and spacing operations between a trailing end regulating plate and a detecting plate in the embodiment 2.

Figure 7:
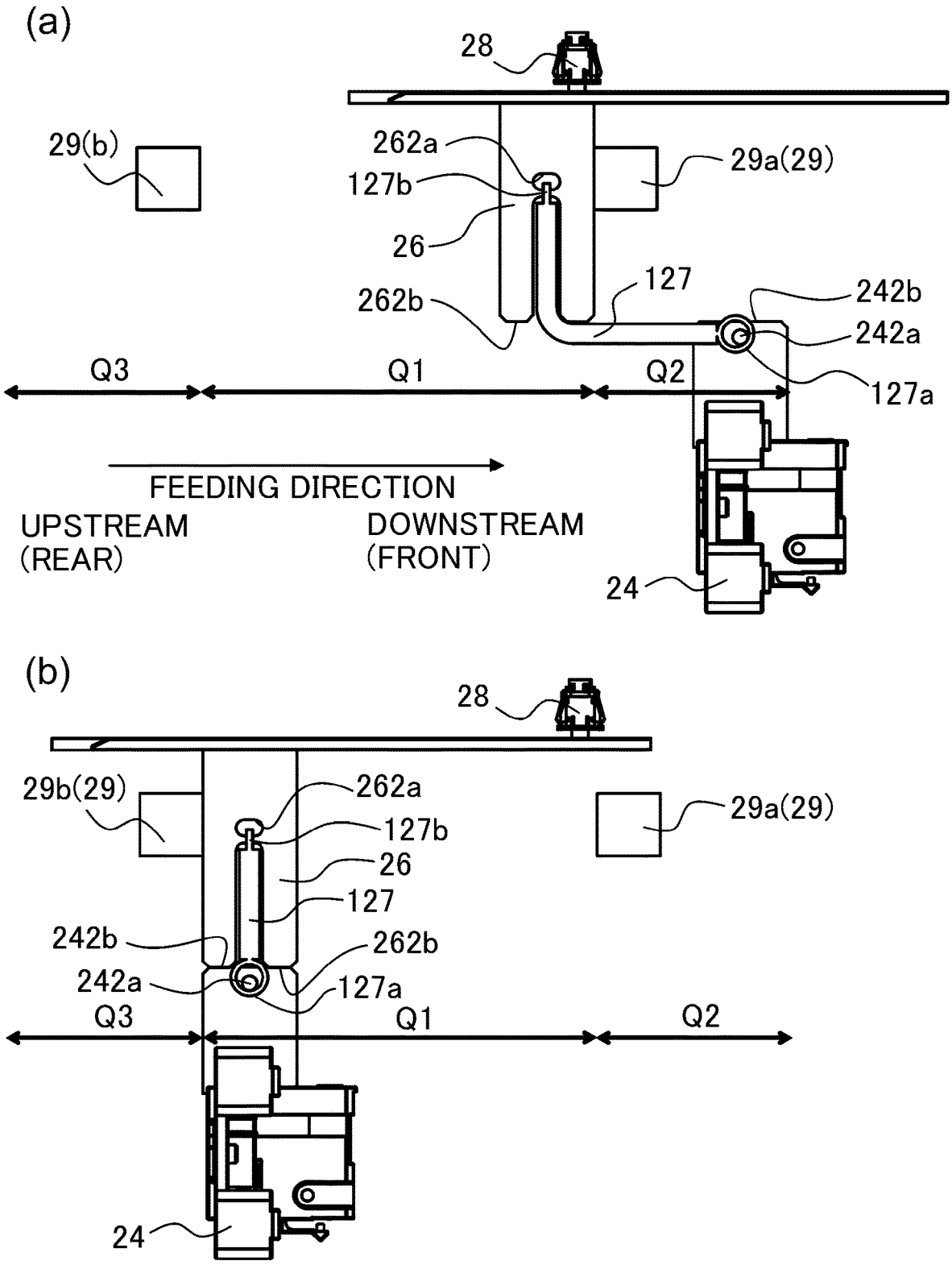

Parts (a) and (b) of FIG. 7 are schematic views showing the interrelation and spacing operations between the trailing end regulating plate and the detecting plate in the embodiment 2.

Figure 8:
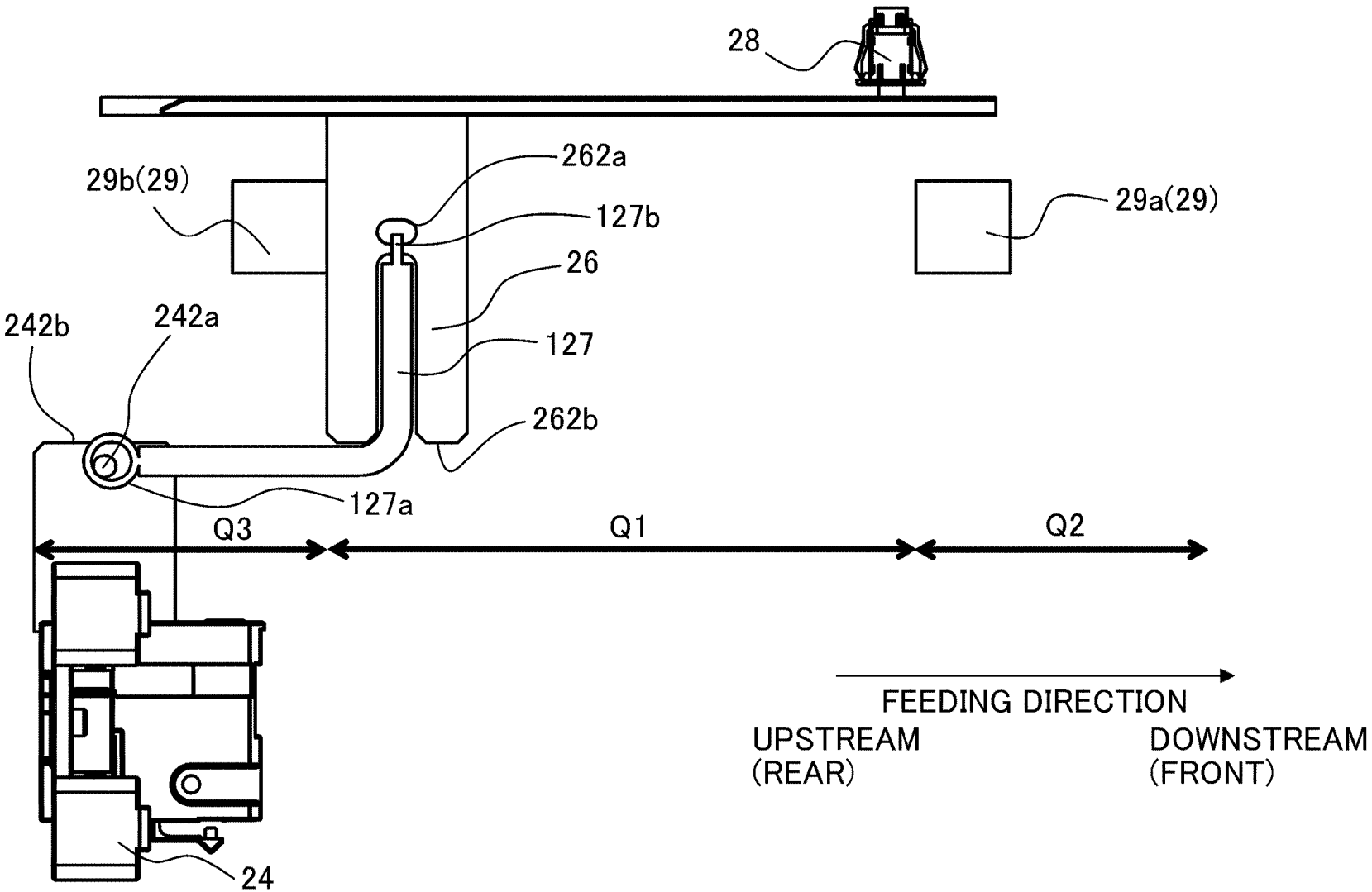

FIG. 8 is a schematic view showing the interrelation and spacing operations between the trailing end regulating plate and the detecting plate in the embodiment 2.

DESCRIPTION OF THE EMBODIMENTS

In the following, embodiments for carrying out the present invention will be described specifically while making reference to the drawings.

Embodiment 1

[General Structure]

Figure 1:
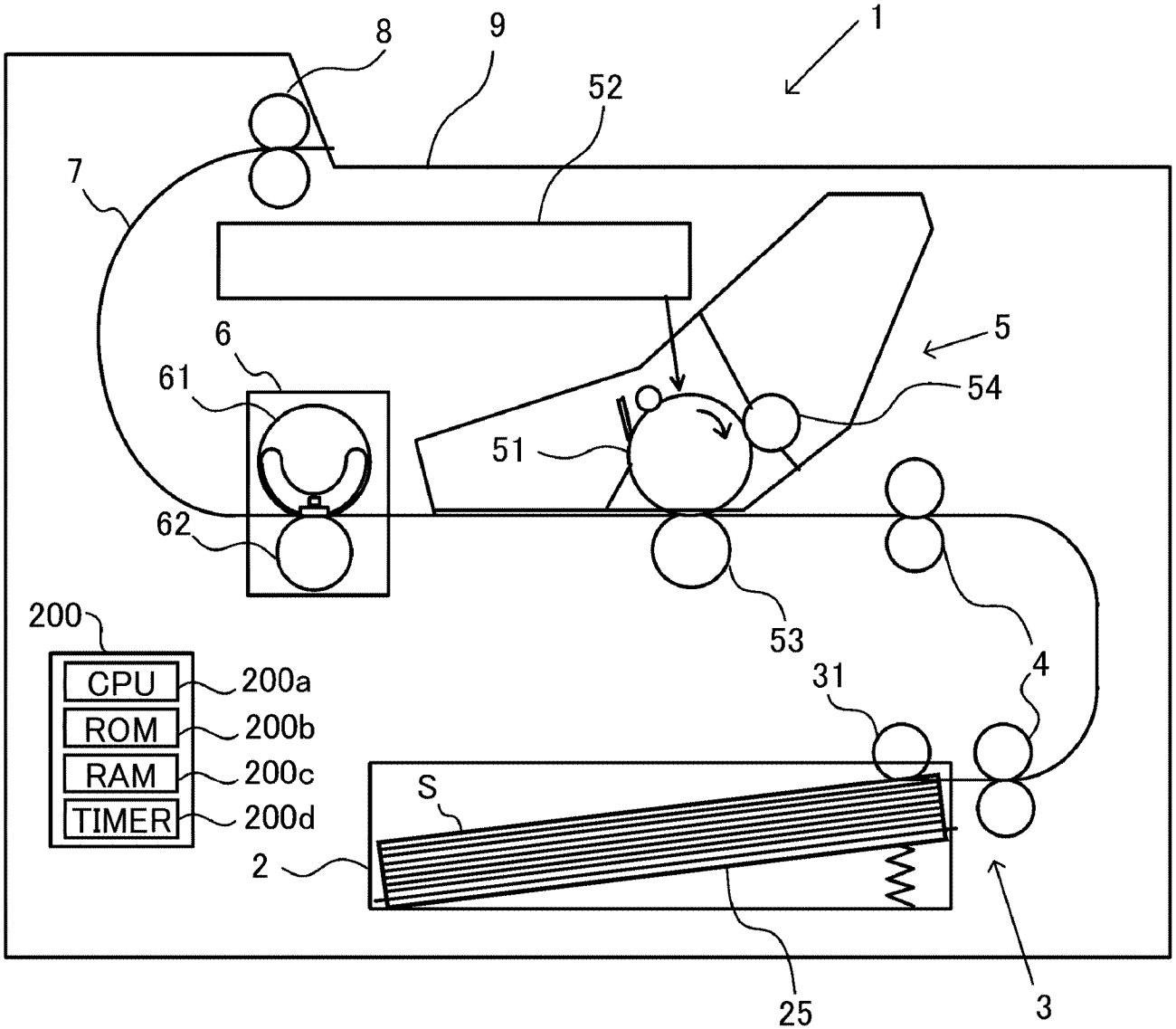
FIG. 1 is a schematic view showing a general structure of a main assembly of an image forming apparatus according to embodiments 1 and 2.

FIG. 1 is a schematic sectional view showing a general structure of an image form 1 and a sheet feeding device. The image forming apparatus 1 forms an image on a recording material (hereinafter, referred to as a sheet) S by an electrophotographic recording type. In the image forming apparatus 1, the sheet S is fed and conveyed to an image forming portion 5 where the toner image is transferred onto the sheet s, and is conveyed to a fixing portion 6 where the toner image is fixed, and thereafter, the sheet S is discharged to a discharge portion.

A feeding device positioned at a lower portion of the image forming apparatus 1 is detachably mountable to a main assembly of the image forming apparatus 1 and includes a cassette unit 2 and a feeding unit 3. The sheets S are stacked and accommodated on a stacking plate 25 of the cassette unit 2. The sheets S are successively fed from an uppermost sheet S by a feeding roller 31 which is a feeding member provided on the feeding unit 3, and is sent to a transfer roller 53 by a conveying roller pair 4. In an image forming portion 5, a surface of a photosensitive drum 51 is irradiated with laser light depending on image information by a laser scanner 52, so that an electrostatic latent image is formed on the photosensitive drum 51 and then is developed with toner by a developing portion 54. The toner image formed in the image forming portion 5 is transferred onto the sheet S under application of a voltage to the transfer roller 53, and then the sheet S is sent to the fixing portion 6. A portion where the toner image is transferred onto the sheet S is a transfer portion. In the fixing portion 6, a fixing nip is formed by a heating unit 61 constituted by a fixing film and a ceramic heater or the like as a heat generating means provided on an inner surface side of the fixing film and by a pressing roller 62 press-contacting the heating unit 61. The fixing nip is also referred to as a fixing portion. An unfixed image on the sheet S passes through the fixing nip and is thus fixed on a surface of the sheet S. Thereafter, the sheet S passes through a discharge passage 7, and is discharged by a discharging roller pair 8 to an outside of the image forming apparatus and is stacked on a discharge tray 9.

In an embodiment 1, as a process of the image forming portion 5 for forming the image on the sheet S, an electrophotographic image forming process using the transfer portion and the fixing portion is employed, but the present invention is not limited thereto. For example, as the image forming portion for forming the image on the sheet S, the present invention may employ an image forming portion using an ink jet image forming process in which the image is formed on the sheet by ejecting an ink liquid through nozzles. Further, the image forming apparatus 1 is not limited to an image forming apparatus for performing monochromatic printing as shown in FIG. 1, but may also be an image forming apparatus for performing color printing.

The image forming apparatus 1 includes a controller 200 for controlling entirety of the image forming apparatus 1, including an image forming operation, a feeding operation of the sheet S, a size detection of the sheet S, and the like by controlling the above-described portions.

The controller 200 includes, for example, a CPU 200*a*. The CPU 200*a* controls a timing by a timer 200*d*, while the CPU 200*a* executes a program stored in a ROM 200*b* while using a RAM 200*c* as a temporary working area.

[Cassette Unit 2]

Figure 2:
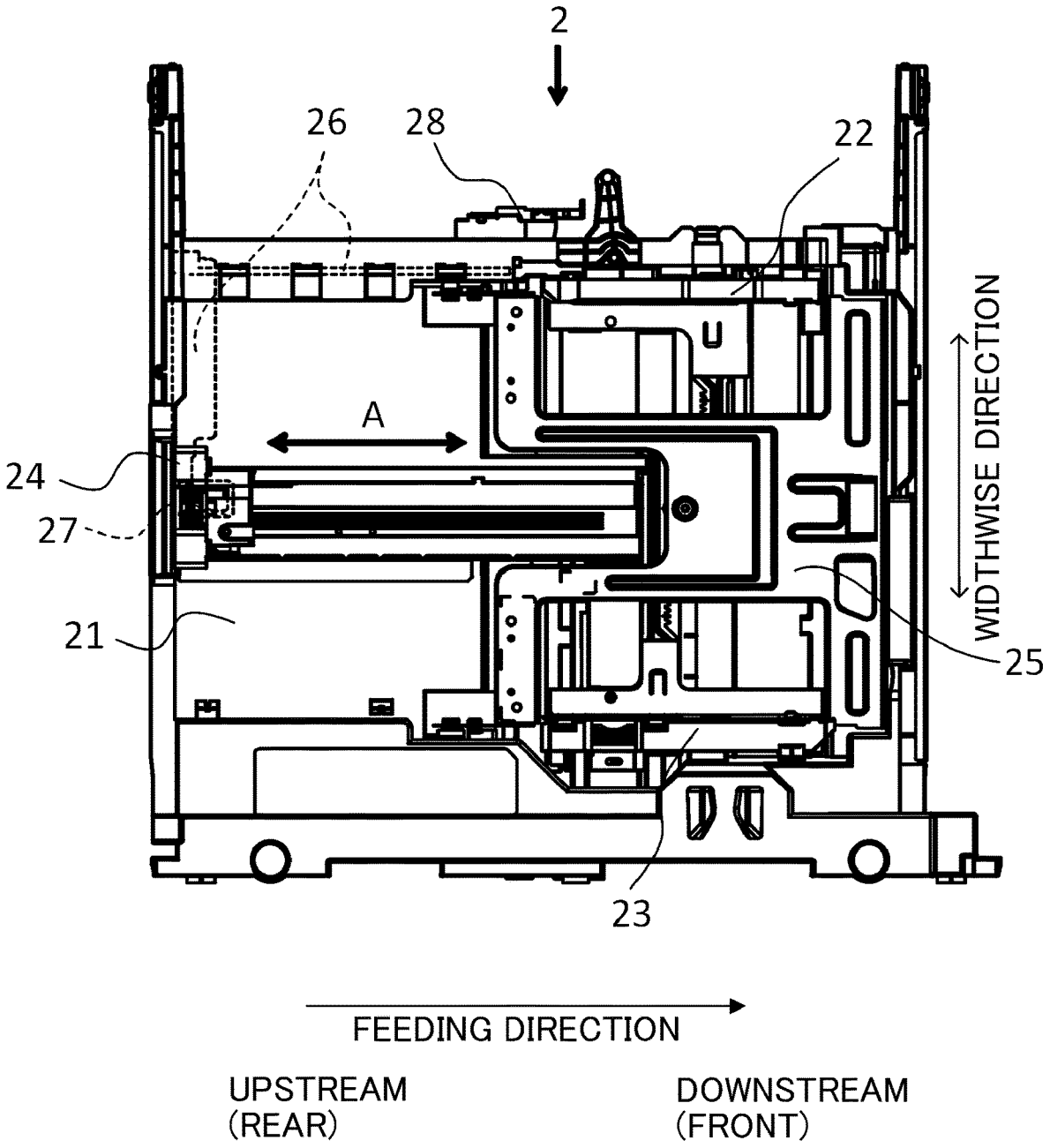
FIG. 2 is a schematic structural view of a paper (sheet) feeding cassette provided in the image forming apparatus of the embodiments 1 and 2.

Next, a detailed structure of the cassette unit 2 mounted in the image forming apparatus 1 will be described using FIGS. 2 and 3. FIG. 2 is a schematic structural view of the cassette unit 2 as viewed from above, in which a feeding direction (upstream (rear), downstream (front)) and a widthwise direction are also shown.

The cassette unit 2 is an accommodating unit in which the sheets S which are recording materials on which the images are formed are accommodated. The cassette unit 2 includes a tray 21, width regulating plates 22 and 23, a trailing end regulating plate 24, a stacking plate 25, a detecting plate 26, and an attracting member 27. On the tray 21, sheets S with large and small various-sizes are stacked. The width regulating plates 22 and 23 regulate the widthwise direction substantially perpendicular to the feeding direction of the sheet S. The term "substantially perpendicular to" not only include the case where the widthwise direction is strictly perpendicular to the feeding direction but also includes the case where the widthwise direction is substantially regarded as being perpendicular to the feeding direction. The trailing end regulating plate 24 which is a regulating member regulates a position of a trailing end of the sheet S with respect to the feeding direction.

The trailing end regulating plate 24 is movable in the feeding direction of the sheet S and regulates the position of an end portion of the sheet S on an upstream side of the feeding direction (i.e., the trailing end of the sheet S). The stacking plate 25 presses the sheet S toward the feeding roller 31. The detecting plate 26 as a member-to-be-detected includes a portion extending in the feeding direction and a portion extending in the widthwise direction as viewed from above as shown in FIG. 2 (see FIG. 4), as has an L-character shape. The detecting plate 26 is operable in interrelation with the trailing end regulating plate 24 in a predetermined region described later. The attracting member 27 which is a connecting member engages with each of the trailing end regulating plate 24 and the detecting plate 26. That is, the attracting member 27 is connected to the trailing end regulating plate 24 at one end and is connected to the detecting plate 26 at the other end, and urges the trailing end regulating plate 24 and the detecting plate 26 in a mutually attracting direction. The attracting member 27 has a first length when the trailing end regulating plate 24 is in a region p 1 described later and has a second length when the trailing end regulating plate 24 is in a region P2 described later, and the second length is longer than the first length.

The width regulating plates 22 and 23 are constituted so that when one width regulating plate (of the width regulating plates 22 and 23) is operated with respect to a predetermined direction of the widthwise direction, the other width regulating plate is operated in interrelation with the one width regulating plate with respect to a direction opposite to the predetermined direction. The trailing end regulating plate 24 is operable in the feeding direction (arrow A direction in FIG. 2). The user sets the width regulating plates 22 and 23 and the trailing end regulating plate 24 in proper positions in accordance with a size of the sheets S stacked. FIG. 3 is an enlarged view of a neighborhood of the attracting member 27 of FIG. 2, and shows a state in which the attracting member 27 engages with each of the trailing end regulating plate 24 and the detecting plate 26 and is operated integrally with these plates. The trailing end regulating plate 24 includes an engaging portion 242 engaging with the attracting member 27, and the detecting plate 26 includes an engaging portion 262 engaging with the attracting member 27. The attracting member 27 includes an engaging portion 27*a* engaging with the engaging portion 242 of the trailing end regulating plate 24 and an engaging portion 27*b* engaging with the engaging portion 262 of the detecting plate 26. The engaging portions 242 and 262 has, for example, a hook-type shape as shown in FIG. 3 and are shaped so that engagement of the engaging portions 242 and 262 with the engaging portions 27*a* and 27*b* respectively, is not release. Incidentally, a method, a shape, and the like of each of the engagement between the engaging portions 242 and 27*a* and the engagement between the engaging portions 262 and 27*b* are not limited to those shown in FIG. 3.

Figure 3:
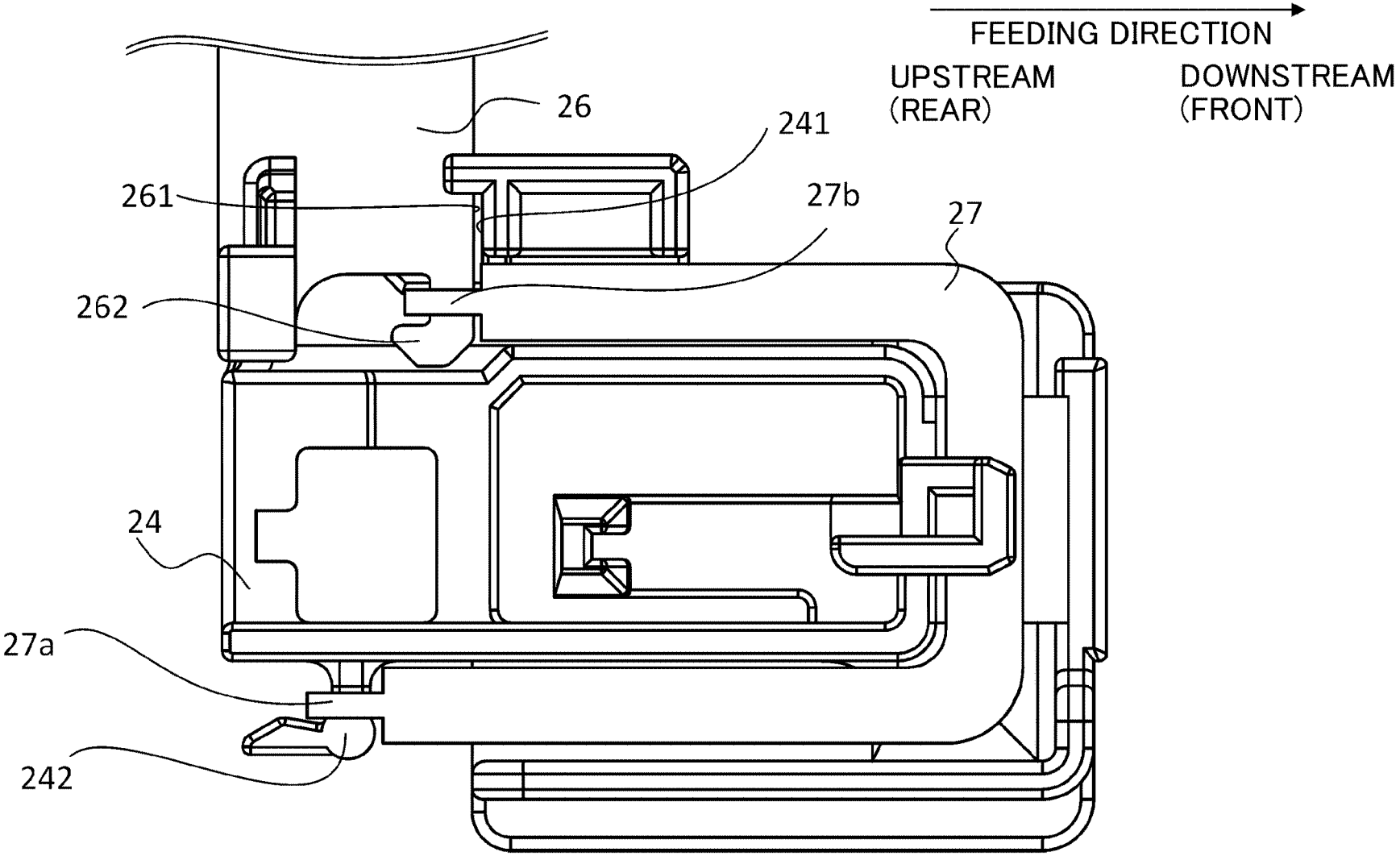
FIG. 3 is an enlarged structural view of a principal part of the paper feeding cassette in the embodiments 1 and 2.

The attracting member 27 is capable of changing in state between a state as shown in FIG. 3 and a state as shown in part (c) of FIG. 5. The attracting member 27 is member having elasticity (flexibility), and is, for example, an elastic (flexible) member such as a rubber or a spring. Further, for example, a constitution in which the trailing end regulating plate 24 includes a winding-up portion (not shown) for winding up the attracting member 27 and in which the attracting member 27 is wound up by the winding-up portion may be employed. As regards the attracting member 27, a length from the engaging portion 27*a* engaging with the engaging portion 242 to the engaging portion 27*b* engaging with the engaging portion 262 is capable of changing from a first length shown in FIG. 3 to a second length, longer than the first length, shown in part (c) of FIG. 5.

In the state of FIG. 3, a contact surface 241 which is a first surface of the trailing end regulating plate 24 contacting the detecting plate 26 and a contact surface 261 which is a second surface of the detecting plate 26 contacting the trailing end regulating plate 24 about against each other. Thus, the trailing end regulating plate 24 includes the contact surface 241 perpendicular to the feeding direction, and the detecting plate 26 includes the contact surface 261 perpendicular to the feeding direction. When the trailing end regulating plate 24 is in the region P1 described later, the contact surface 241 and the contact surface 261 are in contact with each other. When the trailing end regulating plate 24 is in the region P2, the detecting plate 26 contacts a stopper 29 described later and movement thereof is stopped, so that the contact surface 241 and the contact surface 261 are spaced from each other. Further, the contact surface 241 of the trailing end regulating plate 24 with the detecting plate 26 is directed toward a large size side, and the contact surface 261 of the detecting plate 26 with the trailing end regulating plate 24 is directed toward a small size side.

[Size Detecting Constitution]

Figure 4:
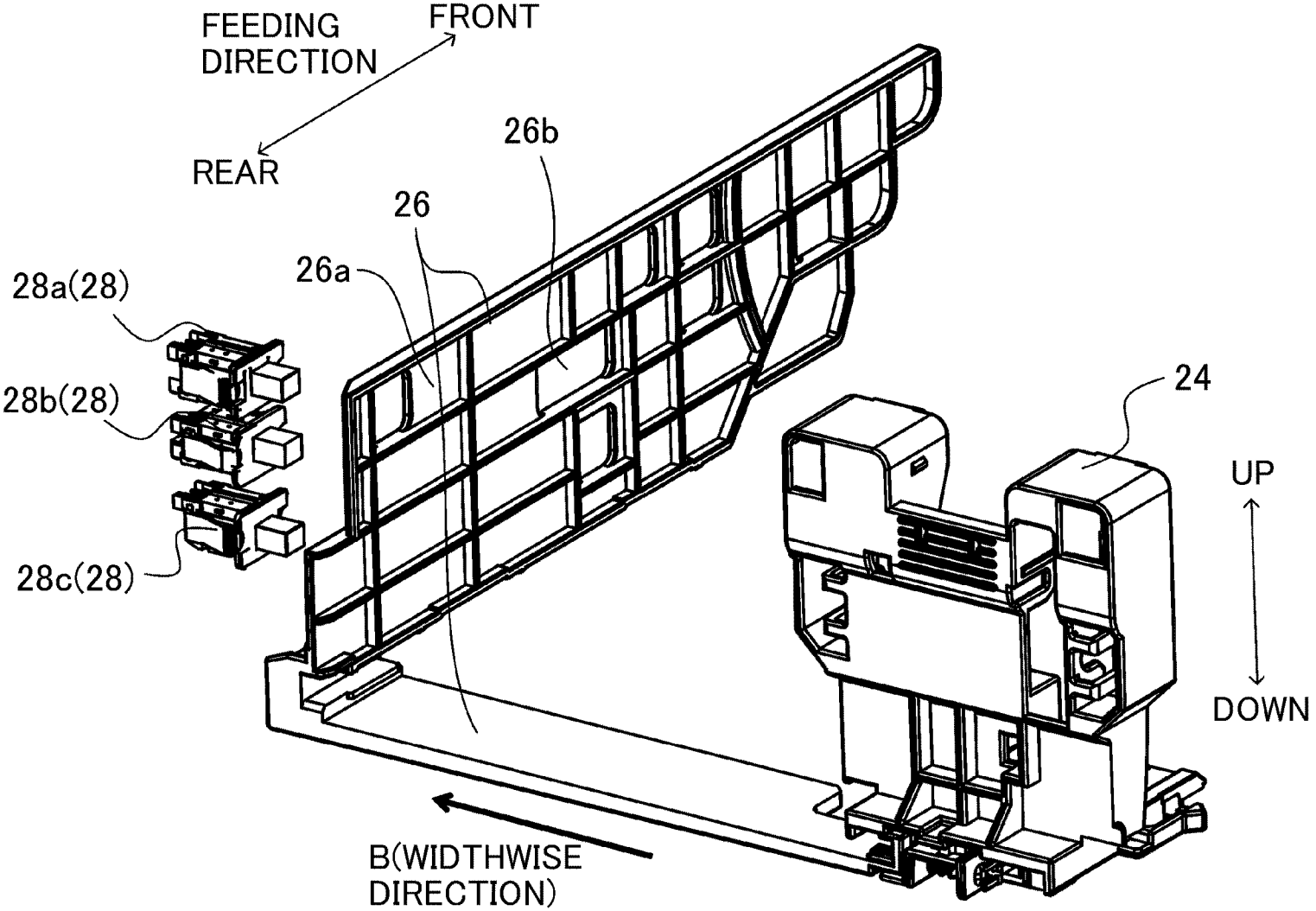
FIG. 4 is a schematic structural view of a size detecting portion provided in the image forming apparatus of the embodiments 1 and 2.

Next, a detailed constitution of size detection for detecting the size of the sheets S set in the cassette unit 2 will be described using FIG. 4. FIG. 4 is a schematic structural view of a size detecting portion in the embodiment 1. A switch 28 which is a detecting device includes a plurality of push switches 28*a*, 28*b* and 28*c*. The switch 28 detects the size of the sheet(s) S accommodated in the accommodating unit by turning on or off the push switches 28*a* to 28*c*. The switch 28 is turned on by pressing of the push switches 28*a* to 28*c* by the detecting plate 26.

The detecting plate 26 moves the feeding direction and changes in position, so that the detecting plate 26 changes an ON/OFF pattern of the switch 28. Incidentally, a signal outputted depending on turning-on or turning-off of the push switches 28*a* to 28*c* is sent to the controller 200. The detecting plate 26 changes, depending on the position thereof with respect to the feeding direction, whether or not which push switches 28*a*, 28*b* and 28*c* are pressed (hereinafter, referred to as a pressing pattern). The detecting plate 26 includes a pressing surface 26*a* and a through hole 26*b*, and depending on arrangement of the pressing surface 26*a* and the through hole 26*b*, the pressing pattern is determined. That is, when the pressing surface 26*a* faces the switch 28, the switch 28 is pressed by the pressing surface 26*a*, and when the through hole 26*b* faces the switch 28, the switch 28 penetrates through the through hole 26*b* and is not pressed by the through hole 26*b*.

Further, by a combination of ON and OFF of the push switches 28*a*, 28*b* and 28*c*, the size of the sheet(s) S set in the cassette unit 2 is discriminated. When the sheets S are set in the cassette unit 2 and then the cassette unit 2 is inserted into the main assembly of the image forming apparatus 1, the detecting plate 26 vertically (B direction widthwise direction)) approaches the switch 28. The detecting plate 26 stops at a position where the switch 28 can be pressed. At this time, the combination of ON and OFF of the switch 28 is determined by the position of the detecting plate 26 and patterns of the pressing surface 26*a* and the through hole 26*b*, i.e., by a position of the trailing end regulating plate 24 depending on the size of the sheet S set in the cassette unit 2. For this reason, the size of the sheet S can be detected by the detecting plate 26 and the switch 28.

[Constitution of Embodiment 1]

The embodiment 1 will be described using FIG. 5. Incidentally, a part of the reference numerals or symbols described with reference to FIG. 3 are only shown in part (c) of FIG. 5 and are omitted from parts (a) and (b) of FIG. 5. In FIG. 5, the feeding direction is shown, and upstream (front) and downstream (rear) when the sheet S is fed are also shown. With respect to the feeding direction of the cassette unit 2, the region P1 which is a first region where the trailing end regulating plate 24 and the detecting plate 26 are in interrelation with each other and the region P2 which is a second region different and spaced from the first region exist. In the region P1 in the feeding direction, the detecting plate 26 contacts the trailing end regulating plate 24, and in the region P2 in the feeding direction, the detecting plate 26 is spaced from the trailing end regulating plate 24 through the attracting member 27. Further, the region P1 in which the two plates are in interrelation with each other is set on an upstream side of the feeding direction, in other words, on a long sheet (hereinafter, referred to as a large size sheet) S side where the length in the feeding direction is long. On the other hand, the region P2 in which the two plates are spaced from each other is set on a short sheet (hereinafter, referred to as a small size sheet) S side where the length in the feeding direction is short.

[Operation of Trailing End Regulating Plate and Detecting Plate]

(Operation in Region P1)

Part (a) of FIG. 5 shows a connection constitution of the trailing end regulating plate 24 and the detecting plate through the attracting member 27 (broken lead line) when a large size sheet S is set. At this time, the detecting plate 26 is pulled by the trailing end regulating plate 24 through the attracting member 27 and contacts the trailing end regulating plate 24, thus being integrated with the trailing end regulating plate 24. That is, the detecting plate 26 is moved in interrelation with motion of the trailing end regulating plate 24.

When the trailing end regulating plate 24 is moved toward a small size side with in a range of the region P1, in other words, toward the downstream side of the feeding direction in the region P1, the detecting plate 26 is pulled by the trailing end regulating plate 24 through the attracting member 27. By this, the detecting plate 26 is moved toward the small size side (downstream side of the feeding direction) while the contact surface 241 of the trailing end regulating plate 24 with the detecting plate 26 and the contact surface 261 of the detecting plate 26 with the trailing end regulating plate 24 are in contact with each other.

When the trailing end regulating plate 24 is moved toward the large size side within a range of the region P1, in other words, toward the upstream side of the feeding direction in the region P1, the detecting plate 26 is moved in the following manner. That is, the detecting plate 26 is pressed by the trailing end regulating plate 24 and is moved toward a large size side (upstream side of the feeding direction) while the contact surface 241 of the trailing end regulating plate 24 with the detecting plate 26 and the contact surface 261 of the detecting plate 26 with the trailing end regulating plate 24 are in contact with each other.

(Operation in the Neighborhood of Boundary Between Region P1 and Region P2)

Part (b) of FIG. 5 shows a position of a boundary where the interrelated state and the spaced state are switched. Here, the stopper 29 which is a stopper member is disposed on the small size side of the cassette unit 2. The stopper 29 restricts motion of the detecting plate 26 when the trailing end regulating plate 24 is moved toward the small size side (downstream side of the feeding direction, region P2) than a range of the region P1 is. Specifically, the stopper 29 prevents the detecting plate 26 from moving toward the downstream side of the feeding direction than the position of the stopper 29 is. The stopper 29 is provided at the boundary between the region P1 and the region P2 and prevents the detecting plate 26 from entering the region P2.

(Operation in Region P2)

Part (c) of FIG. 5 shows a state when the trailing end regulating plate 24 is moved from the state of part (b) of FIG. 5 further toward the small size side (downstream side of the feeding direction) within the range of the region P2. In the region P2, the detecting plate 26 and the stopper 29 are in contact with each other, so that the stopper 29 restricts movement of the detecting plate 26 toward the downstream side of the feeding direction and therefore, the detecting plate 26 is prevented from moving toward the small size side. On the other hand, while the trailing end regulating plate 24 and the detecting plate 26 attract each other through the attracting member 27, the trailing end regulating plate 24 is spaced from the detecting plate 26 and can be moved independently. At this time, the contact surface 241 of the trailing end regulating plate 24 with the detecting plate 26 and the contact surface 261 of the detecting plate 26 with the trailing end regulating plate 24 are spaced from each other.

Thus, when the detecting plate 26 is pulled by the trailing end regulating plate 24 through the attracting member 27 and is integrally operated in contact with the trailing end regulating plate 24, a force acting on the trailing end regulating plate 24 and the detecting plate 26 by the attracting member 27 is completed internally, so that there is no load. For that reason, a relative position between the detecting plate 26 and the switch 28 is not shifted, so that a risk of erroneous detection is low.

Further, when the small size sheet S is set in the cassette unit 2, the trailing end regulating plate 24 and the detecting plate 26 are spaced from each other and are operated as separate members, so that a movement amount of the detecting plate 26 relative to a movement amount of the trailing end regulating plate 24 is reduced and space saving can be realized. Incidentally, in the embodiment 1, an interrelation region between the trailing end regulating plate 24 and the detecting plate 26 is set on the large size side, but may be set on the small size side depending on specifications of the image forming apparatus.

That is, the region P1 is a region in which a trailing end of the large size sheet S larger than a first recording material is included, and the region P2 is a region in which a trailing end of the small size sheet S, smaller than the first recording material, which is a second recording material is included. In this embodiment, the first recording material is a A5-size sheet (148 mm×210 mm) which is a regular size sheet. By the above-described constitution, it becomes possible to compatibly realize ensuring of a detectable range, suppression of a risk of erroneous detection, and downsizing of the size detecting mechanism.

In a constitution in which the regulating member and the member (portion)-to-be-detected are engaged by the attracting member such as to be spaced from each other, an operation region required by the attracting member when the regulating member and the member-to-be-detected are operated in interrelation with each other is small. For this reason, a degree of freedom in range of a size of a detectable sheet is high. Further, a spring force generating between the regulating member and the member-to-be-detected is completed internally, so that the relative position between the member-to-be-detected and the size detecting device is not shifted and thus the risk erroneous detection of the sheet size is low. Further, only the regulating member can be operated in a spaced state from the member-to-be-detected while restricting the movement of the member-to-be-detected. From the above-described reasons, compatibility of these can be achieved.

As described above, according to the embodiment 1, downsizing of the device for detecting the size of the recording material can be realized while accurately detecting the recording materials with various sizes.

Embodiment 2

In the embodiment 1, the case where the non-interrelation region is set only at one end of the interrelation regulating between the trailing end regulating plate 24 and the detecting plate 26 was described, but application of the present invention is not limited thereto. In an embodiment 2, the case where the non-interrelation regions are set at both ends of the interrelation region will be described using FIGS. 6 to 8. Incidentally, a basic constitution of the image forming apparatus 1 is common to the embodiments 1 and 2, and therefore, description will be omitted. Further, in the embodiment 2, component parts having the same constitutions and functions as those in the embodiment 1 are represented by the same reference numerals or symbols as in the embodiment 1.

With respect to the feeding direction of the cassette unit 2, a region Q1 which is a first region where the trailing end regulating plate 24 and the detecting plate 26 are in interrelation with each other, and regions Q2 and Q3 which are a second region where the trailing end regulating plate 24 and the detecting plate 26 are spaced from each other exist. In the region Q1 with respect to the feeding direction, the detecting plate 26 contacts the trailing end regulating plate 24, and in the regions Q2 and Q3 with respect to the feeding direction, the detecting plate 26 is spaced from the trailing end regulating plate 24 through an attracting member 127. Further, the interrelated region Q1 is set on an intermediary size, (hereinafter, referred to as a medium size) between the large size and the small size, side. The spaced region Q2 is set on the small size side (side downstream of the region Q1 with respect to the feeding direction), and the spaced region Q3 is set on the large size side (side upstream of the region Q1 with respect to the feeding direction).

That is, the region Q2 which is a third region is on the side downstream of the region Q1 with respect to the feeding direction, and the region Q3 which is a fourth region is on the side upstream of the region Q1 with respect to the feeding direction. The stopper 29*a* which is a first stopper member is provided at a boundary between the region Q1 and the region Q2 on the region Q2 side, and the detecting plate 26 is prevented from entering the region Q2. The stopper 29*b* which is a second stopper is provided at a boundary between the region Q1 and the region Q3 on the region Q3 side, and the detecting plate 26 is prevented from entering the region Q3.

The trailing end regulating plate 24 includes an engaging portion 242*a* engaging with the attracting member 127, and the detecting plate 26 includes an engaging portion 262*a* engaging with the attracting member 127. The attracting member 127 is connected to the trailing end regulating plate 24 at one end and is connected to the detecting plate 26 at the other end, and urges the trailing end regulating plate 24 and the detecting plate 26 in a mutually attracting direction. The attracting member 127 includes an engaging portion 127*a* engaging with the engaging portion 242*a* of the trailing end regulating plate 24 and an engaging portion 127*b* engaging with the engaging portion 262*a* of the detecting plate 26. For example, as shown in part (a) of FIG. 6, the engaging portion 242*a* has a projected shape, and the engaging portion 127*a* has a ring shape. The engaging portion 242*a* is engaged in the engaging portion 127*a*. For example, as shown in part (a) of FIG. 6, the engaging portion 262*a* is a round (circular) hole, and the engaging portion 127*b* is engaged in the engaging portion 262*a* so as not to be disengaged.

The attracting member 127 is capable of changing in state between a state as shown in FIG. 3 and a state as shown in part (c) of FIG. 5. The attracting member 127 is member having elasticity (flexibility), and is, for example, an elastic (flexible) member such as a rubber or a spring. Further, for example, a constitution in which the trailing end regulating plate 24 includes a winding-up portion (not shown) for winding up the attracting member 127 and in which the attracting member 127 is wound up by the winding-up portion may be employed. As regards the attracting member 127, a length from the engaging portion 127*a* engaging with the engaging portion 242*a* to the engaging portion 127*b* engaging with the engaging portion 262*a* is capable of changing from a first length shown in part (a) of FIG. 6 to a second length, longer than the first length, shown in part (a) of FIG. 7 or FIG. 8. Specifically, the attracting member 127 has a first length when the trailing end regulating plate 24 is in the region Q1, a second length when the trailing end regulating plate 24 is in the region θ2, and a third length when the trailing end regulating plate 24 is in the regulating Q3. Each of the second length and the third length is longer than the first length.

The stoppers 29*a* and 29*b* are provided at a boundary between the regulating Q1 and the regulating Q2 and at a boundary between the region Q1 and the regulating Q3, respectively, and the detecting plate 26 is prevented from entering the regulating Q2 or the regulating Q3. The trailing end regulating plate 24 includes the contact surface 242*b* which is a third surface parallel to the feeding direction, and the detecting plate 26 includes the contact surface 262*b* which is a fourth surface parallel to the feeding direction. When the trailing end regulating plate 24 is in the region Q1 described later, the contact surface 242*b* and the contact surface 262*b* are in contact with each other. When the trailing end regulating plate 24 is in the regions Q2 and Q3, the detecting plate 26 contacts the stoppers 29*a* and 29*b* and movement thereof is stopped, so that the contact surface 241 and the contact surface 262*v* are spaced from each other.

(Operation in Region Q1)

Part (a) of FIG. 6 shows a connection constitution of the trailing end regulating plate 24 and the detecting plate through the attracting member 127 when a medium size sheet S is set. At this time, the detecting plate 26 is pulled by the trailing end regulating plate 24 through the attracting member 127 in a direction (widthwise direction) perpendicular to the feeding direction (operation direction of the trailing end regulating plate 24), and contacts the trailing end regulating plate 24, thus being integrated with the trailing end regulating plate 24. Further, each of the contact surface 242*a* of the trailing end regulating plate 24 with the detecting plate 26 and the contact surface 262*a* of the detecting plate 26 with the trailing end regulating plate 24 is directed in a direction perpendicular to the feeding direction.

When the trailing end regulating plate 24 is moved toward a small size side and a large size side within a range of the region Q1, the detecting plate 26 is moved in the following manner. That is, by the action of the attracting member 127, the detecting plate 26 is moved in the same direction (feeding direction) while the contact surface 242*a* of the trailing end regulating plate 24 with the detecting plate 26 and the contact surface 262*a* of the detecting plate 26 with the trailing end regulating plate 24 are in contact with each other.

(Operation in the Neighborhood of Boundary Between Region Q1 and Region Q2)

Part (b) of FIG. 6 shows a boundary position where interrelation and spacing of the detecting plate 26 relative to the trailing end regulating plate 24 when the trailing end regulating plate 24 is moved from within the range of the region Q1 toward the small size side. Here, the stopper 29*a* is disposed on the small size side of the cassette unit 2, and restricts motion of the detecting plate 26 when the trailing end regulating plate 24 is moved toward the small size side than the range of the region Q1 is.

(Operation in region Q2)

Part (a) of FIG. 7 shows a state in which the trailing end regulating plate 24 is moved from the state of part (b) of FIG. 6 further toward the small size side within the range of the region Q2. In the region Q2, the detecting plate 26 and the stopper 29*a* are in contact with each other, so that the detecting plate 26 is prevented from operating toward the small size side by the stopper 29*a*. On the other hand, while the trailing end regulating plate 24 and the detecting plate 26 attract each other by the attracting member 127, the trailing end regulating plate 24 is spaced from the detecting plate 26 and can be moved independently toward the small size side.

(Operation in the Neighborhood of Boundary Between Region Q1 and Region Q3)

Part (b) of FIG. 7 shows a boundary position where interrelation and spacing of the detecting plate 26 relative to the trailing end regulating plate 24 when the trailing end regulating plate 24 is moved from within the range of the region Q1 toward the large size side. Here, the stopper 29*b* is disposed on the large size side of the cassette unit 2, and restricts motion of the detecting plate 26 when the trailing end regulating plate 24 is moved toward the small size side than the range of the region Q1 is.

(Operation in Region Q3)

FIG. 8 shows a state in which the trailing end regulating plate 24 is moved from the state of part (b) of FIG. 7 further toward the small size side within the range of the region Q3. In the region Q3, the detecting plate 26 and the stopper 29*b* are in contact with each other, so that the detecting plate 26 is prevented from operating toward the large size side by the stopper 29*a*. On the other hand, while the trailing end regulating plate 24 and the detecting plate 26 attract each other by the attracting member 127, the trailing end regulating plate 24 is spaced from the detecting plate 26 and can be moved independently toward the large size side.

As described above, depending on the specifications of the image forming apparatus 1, the interrelation region between the trailing end regulating plate 24 and the detecting plate 26 can be freely set on the large size side, on the small size side, and on both the large size side and the large size side. That is, the region Q1 is a region in which the trailing end of the sheet S with the medium size which is a third recording material is included. The region Q2 is a region in which the trailing end of the sheet S with the small size which is the second recording material smaller in size than the third recording material is included. The region Q3 is a region in which the trailing end of the sheet S with the large size which is the first recording material larger in size than the third recording material is included. For this reason, a degree of freedom in size of a detectable sheet S is high.

Further, when the detecting plate 26 is pulled relative to the trailing end regulating plate 24 by the attracting member 127 and is operated integrally as a unit in contact with each other, the force acting on the trailing end regulating plate 24 and the detecting plate 26 by the attracting member 127 is completed internally. For that reason, the relative position between the detecting plate 26 and the switch 28 is not shifted, so that high stability of the size detection can be realized. Further, when the small size sheet or the large size sheet is set in the cassette unit 2, the trailing end regulating plate 24 and the detecting plate 26 are spaced from each other and are operated as separate members. By this, the movement amount of the detecting plate 26 is reduced relative to the movement amount of the trailing end regulating plate 24, so that it becomes possible to downsize the size detecting mechanism.

Further, in the embodiments 1 and 2, the constitution in which the detecting plate 26 is connected with the trailing end regulating plate 24 through the attracting member 27 or 127 and in which the detecting plate 26 and the trailing end regulating plate 24 are moved toward and away from each other was described, but the present invention is not limited thereto. For example, a constitution in which the detecting plate 26 is connected with the width regulating plates 22 and 23 through the attracting member 27 or 127 and in which the detecting plate 26 is moved toward and away from the width regulating plates 22 and 23 may be employed.

As described above, according to the embodiment 2, downsizing of the device for detecting the size of the recording material while accurately detecting the recording materials with various sizes.

Incidentally, in the embodiments 1 and 2, the feeding device constituting the main assembly of the image forming apparatus 1 was described, but the present invention is not limited thereto. For example, the present invention may be applied to a feeding device (for example, a feeding deck) mounted as an external option on the main assembly of the image forming apparatus 1. The feeding device mounted as the option includes a switch which is a detecting device, and a detection result by the switch is capable of being communicated with the controller 200 of the main assembly of the image forming apparatus 1 by a known technique.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-201639 filed on Dec. 13, 2021, which is hereby incorporated by reference herein in its entirety.

What is claimed is:

1. A feeding device for feeding a sheet, comprising:

an accommodating unit configured to accommodate a recording material;

a feeding member configured to feed the recording material accommodated in the accommodating unit;

a regulating member movable in a feeding direction of the recording material by the feeding member and configured to regulate a position of an end portion of the recording material on an upstream side of the feeding direction;

a member-to-be-detected movable in the feeding direction in interrelation with the regulating member;

a detecting device configured to detect a size of the recording material accommodated in the accommodating unit and of which out signal changes depending on the member-to-be-detected; and a connecting member connected to the regulating member at one end and to the member-to-be-detected at the other end and which urges the member-to-be-detected and the regulating member in a mutually attracting direction, wherein the regulating member contacts the member-to-be-detected in a first region with respect to the feeding direction and is spaced from the member-to-be-detected through the connecting member in a second region different from the first region with respect to the feeding direction.

2. A feeding device according to claim 1, further comprising a stopper member provided between the first region and the second region and configured to restrict the member-to-be-detected so as not to enter the second region.

3. A feeding device according to claim 2, wherein the regulating member has a first surface perpendicular to the feeding direction, wherein the member-to-be-detected has a second surface perpendicular to the feeding direction, wherein when the regulating member is in the first region, the first surface and the second surface are in contact with each other; and wherein when the regulating member is in the second region, the first surface and the second surface are spaced from each other by restriction of movement of the member-to-be-detected through contact of the member-to-be-detected with the stopper member.

4. A feeding device according to claim 3, wherein the connecting member has a first length when the regulating member is in the first region and has a second length when the regulating member is in a second region, the second length being longer than the first length.

5. A feeding device according to claim 2, wherein the regulating member has a third surface parallel to the feeding direction, wherein the member-to-be-detected has a fourth surface parallel to the feeding direction, wherein when the regulating member is in the first region, the third surface and the fourth surface are in contact with each other, and wherein when the regulating member is in the second region, the third surface and the fourth surface are spaced from each other by restriction of movement of the member-to-be-detected through contact of the member-to-be-detected with the stopper member.

6. A feeding device according to claim 5, wherein the second region includes a third region on a side downstream of the first region with respect to the feeding direction and a fourth region on a side upstream of the first region with respect to the feeding direction, and wherein the stopper member includes a first stopper member provided at a boundary between the first region and the third region and configured to restrict the member-to-be-detected so as not to enter the third region and includes a second stopper member provided at a boundary between the first region and the fourth region and configured to restrict the member-to-be-detected so as not to enter the fourth region.

7. A feeding device according to claim 6, wherein the connecting member has a first length, a third length, and a fourth length when the regulating member is in the first region, the third region, and the fourth region, respectively, the third length and the fourth length being longer than the first length.

8. A feeding device according to claim 1, wherein the connecting member is a rubber having elasticity.

9. A feeding device according to claim 8, wherein the regulating member includes a winding-up portion configured to wind up the connecting member.

10. An image forming apparatus comprising:

a feeding device according to claim 1; and an image forming portion configured to form an image on a recording material fed from the feeding device.

* * * * *